United States Patent [19]

Birdwell

[11] 4,098,359

[45] Jul. 4, 1978

[54] HYDRAULICALLY OPERATED DOWNHOLE MOTOR

[76] Inventor: J. C. Birdwell, 8535 Glencrest, Houston, Tex. 77061

[21] Appl. No.: 805,748

[22] Filed: Jun. 13, 1977

[51] Int. Cl.[2] ..... E21B 3/08

[52] U.S. Cl. ..... 175/93; 175/95; 175/107

[58] Field of Search ..... 175/93, 95, 107, 242; 91/468, 470; 60/698

[56] References Cited

U.S. PATENT DOCUMENTS

| | | | |
|---|---|---|---|
| 3,088,529 | 5/1963 | Cullen et al. | 175/107 |
| 3,596,722 | 8/1971 | Allard | 175/93 |

*Primary Examiner*—James A. Leppink
*Attorney, Agent, or Firm*—Donald Gunn

[57] ABSTRACT

A hydraulic motor for use in a drill string is disclosed. The motor incorporates a closed hydraulic system having a piston exposed to variations in mud flow pressure. The piston reciprocates and by its movement pumps hydraulic fluid in a closed hydraulic circuit. A motor is driven. The motor is supported on a hollow drive shaft. The drive shaft extends through the tool. It is hollow to permit mud flow to continue to the drill bit attached therebelow. The motor is attached to the exterior and rotates the shaft. The hydraulic fluid from the motor is returned to a reservoir and flows in a closed circuit from it. All of the equipment is in a closed elongate housing threading into the drill string.

10 Claims, 2 Drawing Figures

HYDRAULICALLY OPERATED DOWNHOLE MOTOR

BACKGROUND OF THE DISCLOSURE

In drilling oil wells, it is sometimes necessary to install a downhole motor. Ordinarily, the motor force for the drilling operation is supplied by equipment at the well head comprising a rotary table and a prime mover connected to the rotary table for imparting rotation to the drill string. Sometimes, it is necessary to operate in a different fashion. As an example, it is sometimes necessary to sidetrack a hole. This is often done by installing a small motor at the bottom of the drill string, just above the drill bit and power the drill bit with a small motor.

The present invention is an improved downhole motor. Many motors have been devised, and it is believed that they are lacking. The present invention overcomes some of these drawbacks by providing a motor which delivers adequate power. Moreover, it is a ruggedized, sealed unit capable of handling very substantial stress. The working environment of the downhole drill bit is quite extreme. That is to say, the drill bit is subjected to high temperatures, sometimes extremely high pressure, and a tremendous amount of vibration. The present invention is a downhole motor which can accommodate the tough environment and yet function for substantial periods of time. Part of this results from the fact that the motor utilizes the drilling mud as a motive means and yet does not induce drilling mud into the motor itself. Drilling mud is the lubricant customarily pumped down the drill string for lubricating the drill bit. It serves other purposes including packing the sidewall of the open hole to prevent lateral leakage. For this reason, drilling mud is a rather heavy fluid made of abrasive materials including, but not limited to, various clays, etc. While the precise composition of drilling mud is not important to the present invention, it is worth observation to note that drilling mud is highly abrasive. The abrasive material is very hard on the working parts of the downhole motor. To this end, motors known heretofore have suffered great damage as a result of the flow of abrasive mud through the equipment.

The present invention does not induce drilling mud into it. More accurately, it has a closed circuit hydraulic system. The hydraulic system is actuated by mud pressure, but the mud is maintained in a controlled channel. More importantly, pressure variations in the mud pressure are used, not the flow of mud itself. This enables the equipment to last much longer.

DETAILED DESCRIPTION OF THE ILLUSTRATED EMBODIMENT

This disclosure is a downhole hydraulically operated motor adapted to be installed in a drill string. It is built in the fashion of a drill collar to fit in the drill string and rotate the drill bit connected therebelow. It has an external housing and a hollow rotatable internal shaft for conducting mud flow through the tool. Pressure variations in the mud react against a piston exposed to the mud. The opposite face of the piston is exposed to the hydraulic oil in a reservoir, and it pressurizes the oil to force it from the sump. The oil flows through a check valve which then connects to an accumulator. The accumulator moderates pressure surges in the line from the check valve. The check valve is connected through an orifice which inputs hydraulic fluid under pressure to a hydraulic motor. The motor is fixedly attached to an internal shaft in the tool, and it rotates a box affixed to the end of the tool. The box is rotated to rotate the drill bit therebelow. Hydraulic oil is returned from the motor to the reservoir through an additional check valve and accumulator.

DETAILED DESCRIPTION OF THE ILLUSTRATED APPARATUS

Figure 1:
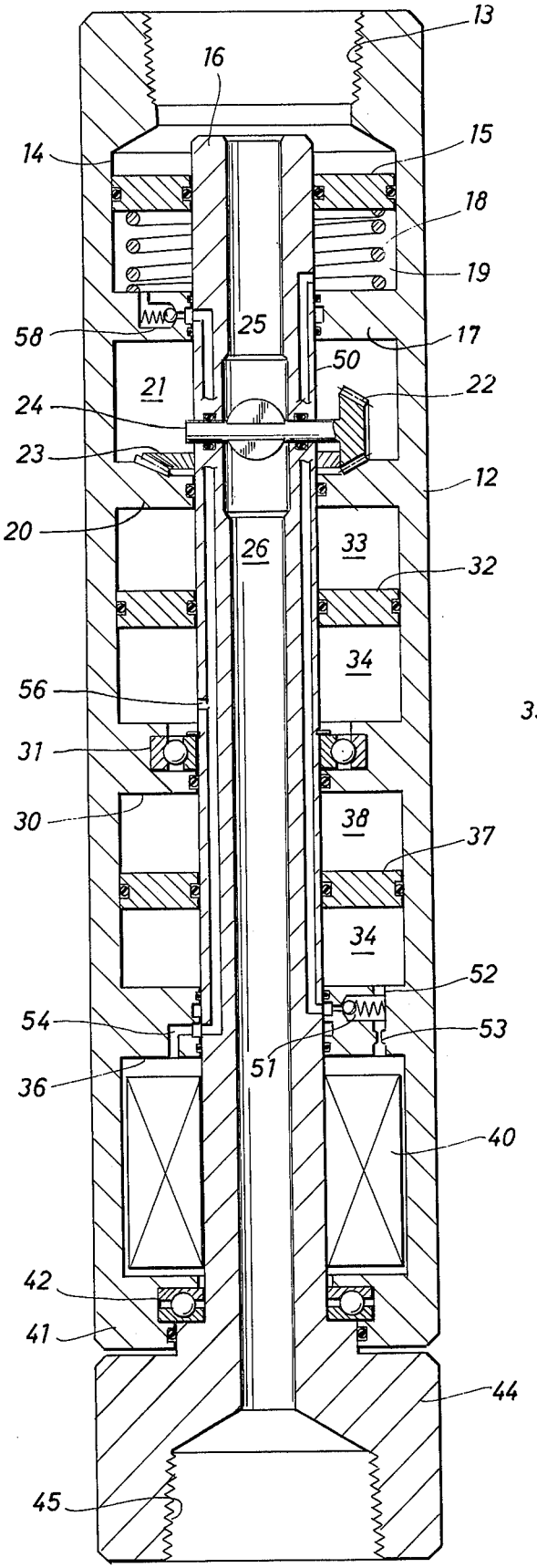
FIG. 1 is a sectional view through the hydraulic motor of the present invention showing internal details of construction.

The disclosed embodiment of FIG. 1 is a hydraulic motor identified by the numeral 10. It is suitably connected to a drill string. The length of the drill string is not material; the drill string incorporates drill pipe at the upper end and drill collars at the lower end. This typical arrangement rotates a drill bit affixed to the bottom of the drill collars. The present invention is adapted to be interposed between the drill bit and the drill collars thereabove. Accordingly, it is suitably constructed for connection to a drill bit and drill collar using pin and box connections in accordance with API standards. The tool thus has an external diameter approximately equal to the diameter of the drill collars. It has an axial internal passage extending from the upper end to the lower end. The passage is sized to permit flow of the mud through the tool which is delivered to the drill bit to lubricate and cool the bit.

For this reason, the device is provided with the industry standard connectors at top and bottom.

The present invention comprises a solid external body 12 having a threaded axial opening 13 at the upper end. The opening defines an inlet or box for drilling mud. Continuing from the upper end, the numeral 14 indentifies an inner wall which defines an enlarged chamber 19. The chamber 19 is open at the upper end and exposed to drilling mud. The chamber is closed by a transverse piston 15. The piston 15 is a flat disklike member which spans the chamber 14. The disk 15 is axially hollow to receive the upper end of a hollow tubular member 16. The disk 15 serves as a piston. To this end, leakage past the disk is prevented by first and second seal rings. The seal rings are located on the interior and exterior surfaces of the piston. The seal rings prevent the intrusion of mud past the piston 15.

The chamber 19 in the housing 14 is defined by a transversely extending wall 17. The wall 17 surrounds the shaft 16 and is sealed against it by spaced seals. The wall 17 is thus parallel to the piston 15. The piston 15 is forced against the mud by a coil spring 18 in the chamber. When the piston moves against the spring, it compresses the spring, and it is returned. The piston is exposed to oscillating pressure in the mud stream. Dependent on the manufacture of pump, the mud flow may have large, or at least small pressure surges. These pressure surges cause the piston to oscillate. The present invention includes means which further accentuate the mud pressure oscillations. This will be described later.

The hydraulic system in the present invention will be set forth after the mechanical structure has been described. Thus, passages are formed in the wall 17 as will be set forth.

The numeral 20 identifies a wall which extends radially inwardly just as the wall 17, and the two are parallel to one another. They define a doughnut shaped chamber 21. The chamber 21 surrounds the shaft 16. It is constructed to receive a gear mechanism including a bevel gear 22 engaging a set of cooperative bevel gear teeth 23 formed in the wall 20. The bevel gear teeth 23 thus define a fixed circular rack cooperative with the movable gear 22. The gear 22 is supported on a shaft 24. The shaft 24 passes through the vertical shaft 16. It is sealed by suitable O-ring seals at the sidewalls of the hollow shaft 16.

The shaft 24 is exposed within the axial passage of the shaft 16. The shaft 24 supports a disk 25 in the open passage 26. The disk 25 has a size which almost closes the passage 26 when it is perpendicular to it. When it is arranged at the angle depicted in FIG. 1, it does not particularly inhibit the flow with the flow of mud through the passage 26. On the other hand, when it is perpendicular to the plane of FIG. 1, it almost closes the passage. This causes a tremendous variation in back pressure. The back pressure variation increases and decreases the pressure acting against the piston 15. When the disk rotates to the illustrated position, back pressure is reduced, and the piston 15 moves accordingly.

The radially directed wall 20 is parallel to another radially directed wall 30. The wall 30 is spaced further down the tool body from the wall 20 so as to define an intermediate chamber. The chamber itself receives a disklike piston 32 which thereby divides the chamber into an upper chamber 33 and a lower chamber 34. The two chambers divided by the piston serve as a pressure accumulator. This will be described in detail. The wall 30 has a central counter bore which receives and supports an alignment bearing 31 about the shaft 16. The shaft is supported by a snap ring at this location.

The numeral 36 identifies another internal, radially directed wall. It is parallel to the wall 30. A piston 37 located in the chamber defines upper chamber 38 and lower chamber 39. The two chambers with the piston comprise a pressure accumulator.

The numeral 40 identifies a hydraulic motor. It has been represented in schematic form. It is located in the chamber below the wall 36. The hydraulic motor is keyed, welded, friction fitted or otherwise joined onto the shaft 16. It rotates the shaft. The motor need not be set forth in detail because hydraulic motors as such are believed to be quite old. A vane type motor furnishing high torque at low speed is desirable. The motor is captured between the internal wall 36 and a lower transverse wall 41. They define a chamber for receiving the motor.

The tool 10 includes the hollow tubular body 12 which terminates at the inwardly directed lower end wall 41. The wall 41 is notched to receive a bearing assembly 42. A thrust bearing assembly is preferably used. This reduces friction as the shaft rotates while tremendous weight is placed on the tool. This particularly enables the tool to operate smoothly without binding, even though the drill bit itself is supporting a very heavy load. The bearing assembly thus is supported on a shoulder at the lower end of the rotatable hollow shaft 16. The shaft 16 flares out into a thickened body 44. The body 44 extends outwardly to full diameter. At a full diameter, it then provides adequate structure for drilling a box connection with a set of API standard threads at 45. The axial passage 26 opens into the threaded area and permits the device to be connected with a drill bit. The drill bit is thus threaded in the box connection.

Figure 2:
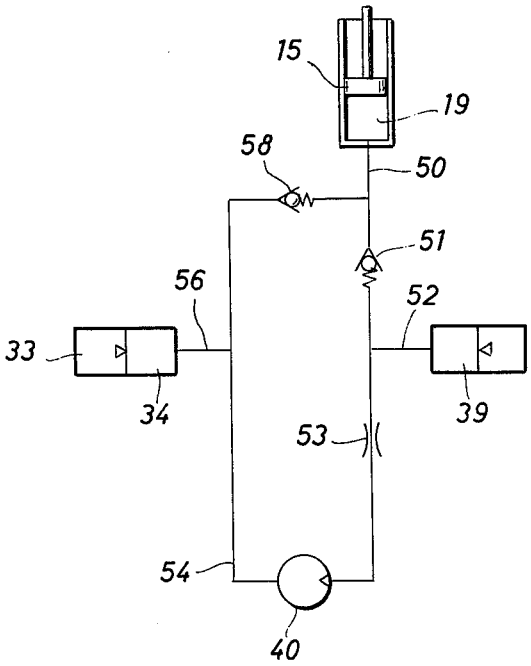
FIG. 2 is a schematic hydraulic system for the present invention.

The foregoing sets forth the body of the tool. There are numerous passages, openings, seal assemblies and the like which have not been described. They will now be described by first referring to FIG. 2 of the drawings, and the particular components will be located and identified. In FIG. 2, the piston 15 is shown. The piston works against an oil reservoir or sump 19. The sump 19 holds hydraulic oil. As the piston 15 oscillates, it pumps oil from the sump.

The oil flows from the sump through a multi-segmented passage 50. The passage 50 extends along the shaft 16 to a check valve assembly 51 located in the transverse wall 36. The check valve assembly prevents back flow towards the sump. The check valve assembly 51 has two outlets, one of which is through a short passage 52 introducing oil under pressure to the chamber 39. This chamber in conjunction with the piston 37 functions as a high pressure accumulator. This modulates the pressure delivered to the hydraulic motor. It takes the pressure surges out. The chamber 38 is preferably filled with a compressable gas maintained at high pressure. Preferably, the gas in the chamber 38 is an inert gas.

The check valve 51 connects to an additional passage having an orifice 53 in it. This delivers hydraulic oil under a controlled and fairly steady pressure level to the motor 40. The motor is rotated. The motor rotates the shaft. The motor exhausts the hydraulic oil through a passage 54. The passage 54 is located in the wall 36. The passage 54 incorporates a commutator to deliver oil under pressure from the fixed wall into a matching passage in the rotating shaft 16. The shaft 16 includes a lengthwise passage having a lateral opening or passage 56. The passage 56 opens into the chamber 34 adjacent to the piston 32. The passage 56 thus delivers oil under lower pressure into the chamber 34. The chamber 33 is filled with a gas, preferably an inert gas. The two chambers in conjunction with the piston 32 serve as a low pressure accumulator. They moderate pressure surges on the low pressure side of the motor 40. The passage 56 thus is the inlet to the accumulator.

The passage 54 continues to a check valve assembly 58. It is located in the wall 17. It will be observed that the rotating shaft is commutated to the check valve. The check valve delivers or returns hydraulic oil from the motor to the hydraulic reservoir 19. The check valve prevents reverse flow.

From the foregoing, it will be understood how the motor is driven. The mud flows through the tool. Pump induced oscillations are present in the mud. They are exaggerated by the rotatable disk which manipulates back pressure in the drilling mud, and, accordingly, the piston 15 is driven to and fro. As it oscillates, it pumps the oil in the reservoir 19. This oil is forced from the reservoir through a closed hydraulic circuit. Its flow is limited by the check valves 51 and 58. The high pressure and low pressure accumulators smooth out surges. Accordingly, hydraulic oil is delivered to the motor for rotating the motor. The motor rotates continuously with the oil being recycled in the closed circuit illustrated in FIG. 2.

The shaft 16 is rotated while the remainder of the apparatus is not. It is possible to place some of the passages in the fixed outer wall rather than the rotatable wall of the shaft 16. However, the illustrated embodiment utilizes the shaft 16 because it extends past all of the equipment in the tool. Moreover, it is easier to drill the shaft 16. To this end, the shaft is provided with at least two lengthwise passages formed in the wall thereof. One delivers oil from the reservoir 19 to the check valve assembly 51, a length spanning the major dimension of the shaft 16. Likewise, low pressure oil is returned from the motor back to the reservoir 19.

The shaft is thus provided with suitable grooves and adjacent seal assemblies. It will be understood that FIG. 1 shows precise alignment of the passage 50 at its lower end with the check valve assembly 51. This alignment, of course, is not always maintained. Because the shaft rotates, the passage 50 may be located on the opposite side from the valve assembly 51. Accordingly, a circular groove is formed in the wall 36 at the point of emergence of the passage extending to the check valve assembly 51. This groove receives and commutates the oil flow from the passage 50 to the check valve 51. This circular commutator construction is duplicated at other locations as necessary. This thus defines a closed circuit hydraulic system.

The device is used in the following manner. It is installed near the bottom of a set of drill collars in a drill string and immediately above the drill bit. The drill string is placed in a hole, and mud flow is initiated. The mud flows through the drill string and the passage 26. As it flows, it creates pressure acting on the piston 15. The piston 15 will move dependent on variations in pressure. As it moves, it pumps oil in the closed hydraulic circuit. As the oil flows, it drives the motor 40 and thereby rotates the shaft 16. When the shaft 16 rotates, the disk 25 is oscillated. As the oil is pumped, the motor 40 automatically operates to rotate the drill bit 10. The operation is just that simple and is continuous as long as mud pressure is maintained through the tool. Its operation is indefinite and because it is a sealed unit, its life is substantially indefinite.

The foregoing is directed to the preferred embodiment, but the scope thereof is determined by the claims which follow.

I claim:

1. A downhole drilling fluid driven motor which comprises:

(a) an elongate, hollow, tubular body adapted to be connected in a drill string to impart rotation to a drill bit therebelow which body incorporates an elongate, hollow tube axially located thereof;

(b) a movable piston supported by said body and having two faces, one of which is exposed to drilling fluid flowing through the drill string and the other face being exposed to hydraulic fluid;

(c) a hydraulic circuit extending from said piston to a motor connected for rotating relatively the hollow tube of said elongate hollow body;

(d) a return from said motor to said piston to define a closed hydraulic circuit;

(e) resilient means for urging said piston against the mud which resilient means works against movement of said piston in response to mud pressure variations which variations pump hydraulic fluid on movement of said piston through said closed hydraulic circuit; and (f) means for controlling the flow of hydraulic fluid from said piston through said closed hydraulic circuit to said motor and in return utilizing said closed hydraulic circuit.

2. The apparatus of claim 1 wherein said piston is a circular disklike member having a central opening therein which permits it to be positioned around said hollow tube in a chamber exposing the upper face of said piston to the drilling mud and wherein said resilient means works against the opposite face thereof.

3. The apparatus of claim 2 including a pressure accumulator connected to the closed hydraulic circuit at a point where the hydraulic fluid is pumped by said piston toward said motor.

4. The apparatus of claim 2 including a pressure accumulator connected to the closed hydraulic circuit at a point where the hydraulic fluid is pumped by said piston toward said motor on the low pressure side of said motor.

5. The apparatus of claim 2 including first and second bearing assemblies supporting said hollow tube in said elongate hollow body for rotation therein, wherein said hollow tube delivers mud flow through said hollow body and incorporates a connector means at the lower end to enable a drill bit to be connected thereto.

6. The apparatus of claim 1, including first and second check valves in said closed hydraulic circuit, one on the high pressure side thereof and the other on the low pressure side thereof which check valves are biased to permit one way flow only.

7. The apparatus of claim 6, including an orifice controlling the flow of hydraulic fluid from the hydraulic circuit into said motor.

8. The apparatus of claim 1, including a rotatable flapper in said hollow tube which is mounted on a transverse shaft for rotation to partially close said hollow tube to thereby vary the back pressure in the drilling mud flowing therethrough and further including gear means connected to said shaft for rotating said flapper.

9. The apparatus of claim 8 wherein said gear means includes first and second bevel gears, one of which is fixed relative to said hollow tube and the other which is fixed relative to said elongate housing.

10. The apparatus of claim 9 including:

(a) first and second bearing assemblies supporting said hollow tube in said elongate hollow body for rotation therein, wherein said hollow tube delivers mud flow through said hollow body and incorporates a connector means at the lower end to enable a drill bit to be connected thereto; and (b) first and second check valves in said closed hydraulic circuit, one on the high pressure side thereof and the other on the low pressure side thereof which check valves are biased to permit one way flow only.

* * * * *